US007409906B2

(12) United States Patent
Bravo et al.

(10) Patent No.: US 7,409,906 B2
(45) Date of Patent: Aug. 12, 2008

(54) OPTICAL SENSOR APPARATUS AND METHOD FOR SENSING INK ERRORS IN OPTICAL DISK MANUFACTURING

(75) Inventors: Jose Jaime Zuniga Bravo, Jalisco (MX); Jesus Ledesma Pacheco, Jalisco (MX)

(73) Assignee: Thomson Licensing, Boulogne Billancourt (FR)

( * ) Notice: Subject to any disclaimer, the term of this patent is extended or adjusted under 35 U.S.C. 154(b) by 469 days.

(21) Appl. No.: 11/170,710

(22) Filed: Jun. 23, 2005

(65) Prior Publication Data

US 2006/0288887 A1 Dec. 28, 2006

(51) Int. Cl.
*B41F 17/00* (2006.01)

(52) U.S. Cl. ..... 101/35; 101/126; 101/129; 101/484; 250/224

(58) Field of Classification Search ..... 101/114, 101/115, 123, 124, 127.1, 129, 484, 485, 101/35, 126; 250/224, 229, 239
See application file for complete search history.

(56) References Cited

U.S. PATENT DOCUMENTS

| | | | | |
|---|---|---|---|---|
| 3,668,407 | A * | 6/1972 | Matzen et al. | 250/229 |
| 5,479,854 | A * | 1/1996 | Chikahisa et al. | 101/123 |
| 7,013,806 | B2 * | 3/2006 | Fromson et al. | 101/465 |
| 7,115,871 | B1 * | 10/2006 | Tracy et al. | 250/349 |
| 2005/0014178 | A1 * | 1/2005 | Holm-Kennedy | 435/6 |
| 2005/0186002 | A1 * | 8/2005 | Matsutake | 400/63 |

* cited by examiner

*Primary Examiner*—Ren Yan
(74) *Attorney, Agent, or Firm*—Joseph J. Laks; Robert B. Levy; Wan Yee Cheung

(57) ABSTRACT

An apparatus, system and method for detecting ink errors in optical disk printing are provided. The apparatus, system and method include a sensor mount structure and a plurality of optical sensors mounted on the mount structure and in registration with a print table. A controller selectively activates the optical sensors in accordance with a relative motion between the optical sensors and the printing station such that the optical sensors each scan an assigned region of the print table to detect ink outside of an area where an object to be printed is placed.

19 Claims, 3 Drawing Sheets

OPTICAL SENSOR APPARATUS AND METHOD FOR SENSING INK ERRORS IN OPTICAL DISK MANUFACTURING

FIELD OF THE INVENTION

The present invention generally relates to optical disk manufacturing, and more particularly to a system and method for more accurately detecting ink errors during printing on optical disks.

BACKGROUND OF THE INVENTION

Optical disks are often inked for identification, advertising or other purposes. During the inking process, an optical disk, such as a compact disk (CD) or digital video disk (DVD) are passed through a printing machine. The disk is attached to a carrier to protect and secure the disk. Then, the carrier and disk are put through one or more inking steps. Each step can include a different color ink. Most printing machines include a screen tear-off sensor that is a device that detects ink, usually, white ink, on the disk carrier of the printing machine.

A tear in a screen used for printing (i.e., a screen tear-off) or other inking errors may cause ink to fall on a print table, the carrier or collect too much ink in one area of the disk. That is, a screen tear-off, for example, will cause the print table to be stained with ink. In conventional machines, such as offset printing machines, a sensor is installed which is intended to detect white base screen tear-off printing errors. The operation of this sensor is based in the change of height that would occur in the machine print table caused by the white ink falling off of a printing screen at the time of a screen tear-off. More specifically, such a sensor is blocked by ink on the print table, looking at it side-to-side.

Referring to FIG. 1, a high level block diagram of a cross-section of a relevant portion of a screen offset printing machine 10 is illustratively depicted. Machine 10 includes a housing 12. Housing 12 incorporates a screen tear-off sensor 14, which receives light 18, preferably laser light or LED light, from a source 16. During printing, white ink 22 is applied to a surface of an optical disk 24.

Currently, offset printing machines come with a sensor similar to sensor 14, which is intended to detect white base screen tear-offs. The purpose of this sensor 14 is to detect a change in the height that would occur on a machine print table 20 caused by white ink falling off a screen 11 in housing 12 at the time of a screen tear-off (e.g., the sensor 14 is blocked by ink on the print table 20, from a side position). However, not all screen tear-off ink errors cause a change of height large enough and long enough for the sensor to detect, thus causing the screen tear-off to be unnoticed by the machine control.

Such unnoticed ink errors can cause offset head rollers used in the printing process to become dirty with ink. The offset head rollers need to be cleaned immediately to avoid further print defects that would affect product quality caused by the staining of subsequent disks with ink from the offset head rollers. Disks with such ink defects due to the failure to detect the ink errors in printing immediately, need to be scrapped. Even further, and each occurrence typically causes more than an hour of machine downtime. Although printing machines automatically stop when the disks reach the end of the printing machine due to an included print scanner inspection in the printing process, by the time a first disk having an ink error is detected by the print scanner inspection, many subsequent discs already have ink defects.

Furthermore, in such prior art printing systems including ink error sensors, such as the screen offset printing machine of FIG. 1, the sensors 14 require accurate calibration, which can be a sensitive and lengthy process, and even if properly aligned, many screen tear-off ink errors will not be noticed by the sensor.

Therefore, a need exists for a system and method, which provides improved detection of screen tear-off conditions and other ink errors on at least a printing table of disk printing systems.

SUMMARY OF THE INVENTION

An apparatus, system and method for detecting ink defects in optical disk printing process and printing station is provided.

In one embodiment of the present invention, an apparatus for detecting ink defects in a printing station during a printing process of an object, includes a plurality of spaced apart optical sensors mounted in registration with a printing area of the printing station, and a controller which selectively activates the optical sensors in accordance with a relative motion between the optical sensors and the printing station such that the optical sensors each scan an assigned region of the printing area to detect ink outside of an area where the object to be printed is placed.

In an alternate embodiment of the present invention, a method for detecting ink defects in an object printing process includes selectively activating optical sensors in an array of optical sensors disposed over a print table in accordance with a relative motion between the array of optical sensors and the print table such that the optical sensors each scan an assigned region of the print table to detect ink outside of an area where the object to be printed is placed.

BRIEF DESCRIPTION OF THE DRAWINGS

The teachings of the present invention can be readily understood by considering the following detailed description in conjunction with the accompanying drawings, in which.

Figure 1:
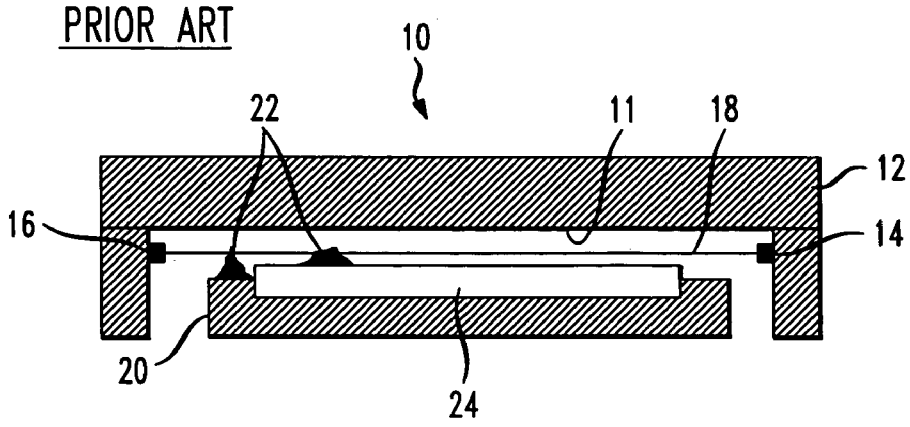
FIG. 1 PRIOR ART
FIG. 1 depicts a cross-sectional view of a prior art tear-off sensor system for detecting ink buildup and errors.

To facilitate understanding, identical reference numerals have been used, where possible, to designate identical elements that are common to the figures. It should be understood that the drawings are for purposes of illustrating the concepts of the invention and are not necessarily the only possible configuration for illustrating the invention.

DETAILED DESCRIPTION OF THE INVENTION

The present invention provides a sensor system and method which advantageously more thoroughly scans at least a print table for ink errors during a printing process for an optical disk. In one useful embodiment, a white screen tear-off operation is based in a control station that uses a plurality of optic sensors to scan a surface of the print table from above. A first group of sensors detects ink presence on the outer edges of the print table and another group detects ink presence on the middle edges of the print table. In one embodiment, the detection is synchronized to the print table movement so that the inked disk surface does not trigger a stop.

It is to be understood that the present invention is described in terms of an illustrative system and method for offset and/or screen printing of optical disks; however, the present invention is much broader and may include any ink printing operation on any type of substrate or material, such as toys, plastic labels, etc. It should be further understood that the elements shown in the figures may be implemented in various forms of hardware, software or combinations thereof. Preferably, these elements are implemented in hardware and may be controlled by software on one or more appropriately programmed general-purpose devices, which may include a processor, memory and input/output interfaces.

Figure 2:
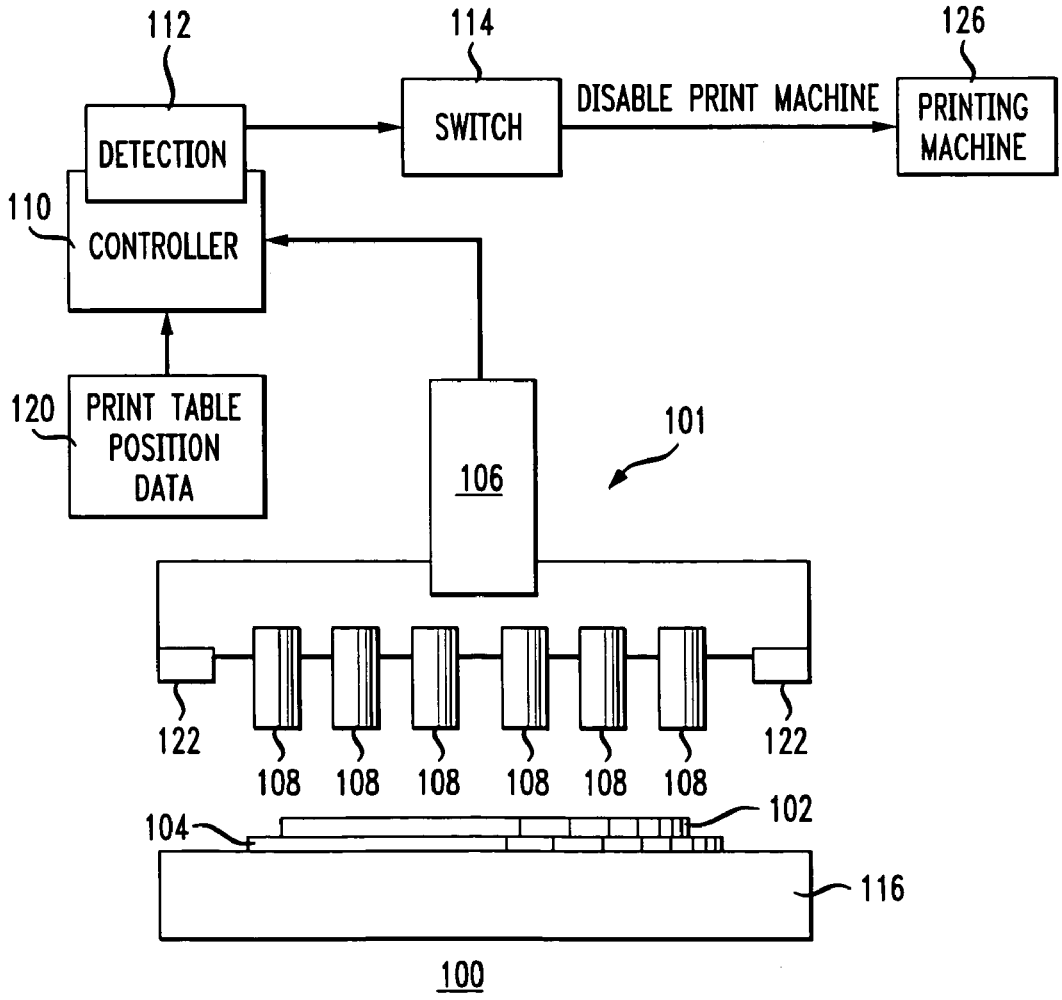
FIG. 2 depicts a high level block diagram of a system/apparatus for detecting ink buildup and errors in accordance with one embodiment of the present invention.

Referring now in specific detail to the drawings in which like reference numerals identify similar or identical elements throughout the several views, and initially to FIG. 2, a system 100 is shown in accordance with an illustrative embodiment of the present invention. Details of the individual block components making up the system architecture which are known to skilled artisans will only be described in details sufficient for an understanding of the present invention. System 100 may be installed in or connected to a printing machine and used for inspecting a substrate 102 or other object to be inked or printed on.

In a preferred embodiment, substrate or object 102 comprises an optical disk, such as a compact disk (CD) or digital video disk (DVD). Object 102 is secured by or to a carrier 104 which supports the object, and includes a portion which surround the object 102. The carrier 104 is preferred, but optional. A sensor assembly 101 includes a mounting structure 106 adapted to receive or secure a plurality of sensors 108.

Sensors 108 may include fiber optic sensors or photosensors configured to receive light from above the object 102. Light may be provided on object 102 by one or more light sources 122. Alternately, light may be provided and received by fiber optic sensors 108. Sensors 108 are employed to scan a print table or surface 116 or carrier 104 from above, preferably after a first ink curing station. In other words, a base layer of white ink is applied to the object 102 followed by a curing process, e.g., an ultra-violet (UV) cure process. Then, the object 102 with the cured ink is scanned. Structure 106 may be employed after each inking process as needed.

In one embodiment of the present invention, the operation of the sensors 108 is synchronized to the machine movement by a controller 110, which has machine movement data input or synchronization data 120 applied thereto so that the white disk surface of object 102 is not scanned. Position information for the machine print table may be coded and input to controller 110, which can then decide which sensor to activate/deactivate during scanning. In an alternate embodiment, the activation and deactivation of sensors 108 may be performed by timing data. For example, at time equal to zero all sensors are on, at time equal to 10, the middle two sensors are turned off, at time equal to 20, all sensors 108 are turned off except the end two sensors. Other schemes are also contemplated.

Advantageously, ink smears on the print table 116 are detected by a detection module 112, which may be incorporated into the controller 110. Detection module 112 may be implemented in software and check for changes in measured intensity (e.g., increases or decreases depending on the ink type and color) of light sensed by the sensors 108. If a significant change is determined (e.g. above a set intensity threshold value), the controller 110 triggers a machine stop using a switch 114 or like device. At such time, print machine 126 is halted or completely shut down.

Figure 3:
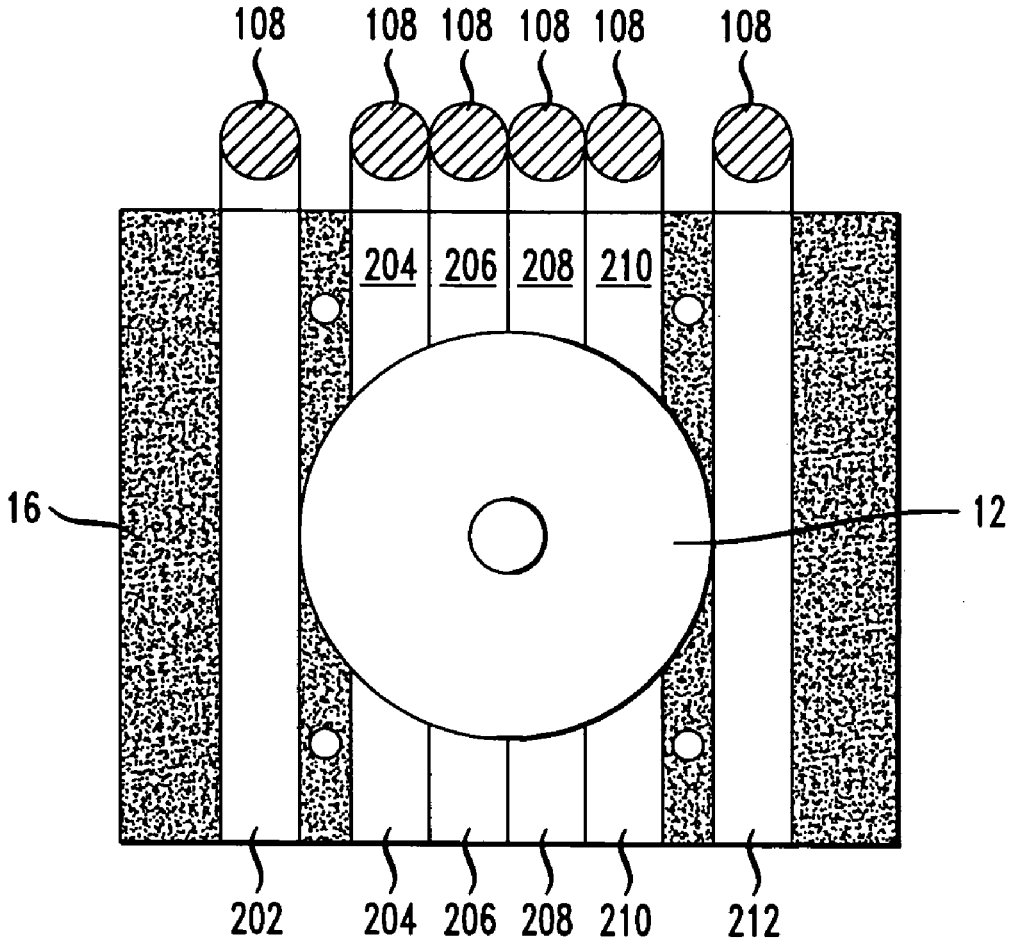
FIG. 3 depicts a top view of a print table indicating sensor scan areas in accordance with an embodiment of the present invention.

Referring to FIG. 3, a schematic diagram showing scan areas 202-212 is illustratively depicted in accordance with one embodiment of the present invention. Sensors 108 are moved across print table 116 or print table is moved below sensors 108. Scan areas 202-212 correspond to each of the sensors 108. Sensors are deactivated over object 102 to prevent confusing light reflected back from the inked disk.

For a white base printing, a white screen tear-off may cause the print table 116 to be stained with ink. As sensors 108 move relative to disk carrier 104 and disk 102 reflectivity measurements are made. The controller (110 in FIG. 2) receives synchronization signals from the machine and evaluates the state of each of the sensors 108. Since the position of the disk 102 is known in advance, sensors 108 in regions 204, 206, 208 and 210 are deactivated over disk 102 and reactivated once beyond or past disk 102. Sensors 108 for regions 202 and 212 provide an edge sweep of the disk 102 and do not need to be turned on and off.

Since the illumination of the carrier 104 changes in the presence of white ink (or other ink colors), an increase in reflected light is easily detected. A white screen tear-off, for example, may cause the print table/carrier to be stained with ink. This will be detected by the present system and the printing machine will be stopped when ink is detected on top of the print table.

A prototype unit has been installed and tested in a printing machine and the results after one month of operation have been 100% detection of screen breaks within 2 to 3 disks of occurrence. This is a drastic difference from the 30 or so disks that required replacing under typical prior art methods. Cleaning time is drastically reduced to around 8 minutes or less due to the reduction in the number of disks affected and, because the problem does not reach the offset heads where it would have caused more contamination to the offset head rollers. This is significantly less than the more than one hour needed for clean-up using prior art techniques.

Figure 4:
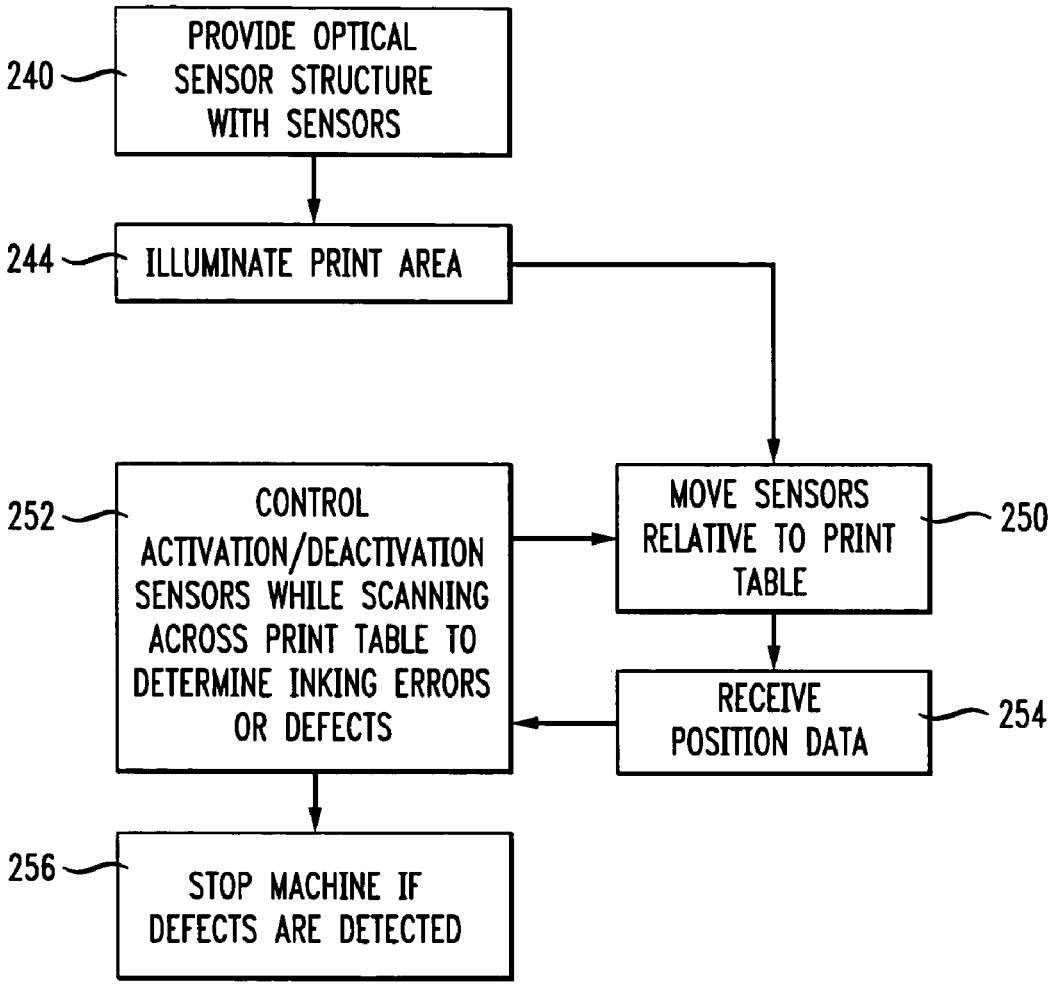
FIG. 4 depicts a block/flow diagram of a method for detecting ink buildup and errors in accordance with an embodiment of the present invention.

Referring to FIG. 4, a method for detecting ink defects in optical disk manufacture is illustratively shown. In block 240, a sensor mount structure is provided which is disposed over a print table with a plurality of optical sensors mounted on the mount structure and spaced apart from one another. In block 244, the step of illuminating the print area with light sources to more easily identify the ink errors is included.

Block 250 includes scanning across the print table by moving the sensor mount structure relative to the print table or by moving the print table relative to the sensor mount structure. In block 254, receiving position data for relative positions between the sensors and the scan areas to determine when to activate and deactivate each sensor is included.

In block 252, activation and deactivation of the optical sensors is controlled in accordance with the position data over the scan area regions on the print table such that the optical sensors each scan a given print area to detect ink outside of an area where the optical disk is placed. In block 256, printing operations are stopped for the printing machine when ink is detected in one or more of the scan areas.

Having described preferred embodiments for an optical sensor apparatus and method for sensing ink errors in optical disk manufacturing (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. As such, the appropriate scope of the invention is to be determined according to the claims, which follow.

The invention claimed is:

1. A system for detecting ink defects in an optical disk printing process, comprising:

a printing machine for applying ink to optical disks, the printing machine including a print table;

a sensor mount structure disposed over the print table;

a plurality of optical sensors mounted on the mount structure and in registration with said printing table and configured to scan at least a surface of the print table; and a controller which selectively activates said optical sensors in accordance with a relative motion between said optical sensors and said printing table such that movement of the sensors relative to the print table enables said optical sensors to each scan an assigned region of said printing table to detect ink outside of an area where said optical disks to be printed are placed.

2. The system of claim 1, wherein the print machine comprises a screen printer.

3. The system of claim 1, wherein the controller receives position data from said printing machine for determining relative positions between the sensors and the printing table for selectively activating the optical sensors.

4. The system of claim 1, wherein the controller is coupled to a switch for stopping printing operations when ink is detected outside of an area where said optical disks are placed.

5. The system of claim 1, wherein the sensor mount structure disposes the sensors along a line.

6. The system of claim 1, comprising at least one light source for illuminating the print table.

7. The system of claim 6, wherein said at least one light source is positioned on said mount structure.

8. An apparatus for detecting ink defects in a printing station during a printing process of an object, comprising:

a plurality of spaced apart optical sensors mounted above and in registration with a printing area of said printing station and configured to scan at least a surface of the printing area; and a controller which selectively activates said optical sensors in accordance with a relative motion between said optical sensors and said printing station such that movement of the sensors relative to the printing station enables said optical sensors to each scan an assigned region of said printing area to detect ink outside of an area where said object to be printed is placed.

9. The apparatus of claim 8, wherein the object comprises a compact disk or a digital video disk.

10. The apparatus of claim 8, wherein the controller receives position data from said printing station for determining relative positions between the sensors and the printing station for selectively activating the optical sensors.

11. The apparatus of claim 8, wherein the controller is coupled to a switch for stopping printing operations when ink is detected outside of an area where said object to be printed is placed.

12. The apparatus of claim 8, wherein each sensor is disposed along a line.

13. A method for detecting ink defects in an object printing process, comprising the steps of:

providing an array of optical sensors comprising a plurality of optical sensors mounted above a print table and configured to scan at least a surface of the print table; and selectively activating said optical sensors in the array of optical sensors disposed over the print table in accordance with a relative motion between the array of optical sensors and the print table such that movement of the sensors relative to the print table enables the optical sensors to each scan an assigned region of the print table to detect ink outside of an area where said object to be printed is placed.

14. The method of claim 13, wherein the step of selectively activating comprises scanning across the print table by moving the array of optical sensors relative to the print table and selectively activating the optical sensors not disposed over said object to be scanned.

15. The method of claim 13, wherein the step of selectively activating comprises scanning across the print table by moving the print table relative to the array of optical sensors and selectively activating the optical sensors not disposed over said object to be scanned.

16. The method of claim 13, comprising the step of using position data for relative positions between the sensors and the print table to determine when to activate each sensor.

17. The method of claim 13, comprising the step of stopping printing operations of the printing machine when ink is detected outside of an area where said object to be printed is placed.

18. The method of claim 13, wherein the optical sensors in the array of optical sensors are disposed along a line.

19. The method of claim 13, comprising the step of illuminating the print table with at least one light source.

* * * * *